US009407992B2

(12) United States Patent
Gao et al.

(10) Patent No.: US 9,407,992 B2
(45) Date of Patent: Aug. 2, 2016

(54) ESTIMATION OF REVERBERATION DECAY RELATED APPLICATIONS

(71) Applicant: Conexant Systems, Inc., Irvine, CA (US)

(72) Inventors: Chris X. Gao, Mississauga (CA); Govind Kannan, Irvine, CA (US); Youhong Lu, Irvine, CA (US); Trausti Thormundsson, Irvine, CA (US); Vilhjalmur S. Thorvaldsson, Irvine, CA (US)

(73) Assignee: CONEXANT SYSTEMS, INC., Irvine, CA (US)

( * ) Notice: Subject to any disclaimer, the term of this patent is extended or adjusted under 35 U.S.C. 154(b) by 124 days.

(21) Appl. No.: 14/105,765

(22) Filed: Dec. 13, 2013

(65) Prior Publication Data

US 2014/0169575 A1 Jun. 19, 2014

Related U.S. Application Data

(60) Provisional application No. 61/737,590, filed on Dec. 14, 2012.

(51) Int. Cl.
*H04R 3/00* (2006.01)
*H04R 3/02* (2006.01)

(52) U.S. Cl.
CPC ..... *H04R 3/02* (2013.01)

(58) Field of Classification Search
None
See application file for complete search history.

(56) References Cited

U.S. PATENT DOCUMENTS

| | | | | |
|---|---|---|---|---|
| 5,109,419 | A * | 4/1992 | Griesinger | 381/63 |
| 8,284,947 | B2 | 10/2012 | Giesbrecht et al. | |
| 9,002,024 | B2 * | 4/2015 | Nakadai et al. | 381/66 |
| 2004/0213415 | A1 | 10/2004 | Rama et al. | |
| 2005/0244023 | A1 * | 11/2005 | Roeck et al. | 381/321 |
| 2006/0115095 | A1 | 6/2006 | Giesbrecht et al. | |
| 2006/0115100 | A1 * | 6/2006 | Faller | 381/119 |
| 2008/0069366 | A1 | 3/2008 | Soulodre | |
| 2008/0285774 | A1 * | 11/2008 | Kanamori et al. | 381/94.3 |
| 2011/0268283 | A1 * | 11/2011 | Nakadai et al. | 381/56 |
| 2013/0028432 | A1 * | 1/2013 | Suzuki et al. | 381/66 |
| 2013/0136273 | A1 * | 5/2013 | Marash et al. | 381/92 |
| 2013/0142341 | A1 * | 6/2013 | Del Galdo et al. | 381/23 |
| 2013/0208903 | A1 | 8/2013 | Ojala | |
| 2014/0169575 | A1 * | 6/2014 | Gao et al. | 381/63 |
| 2014/0177857 | A1 * | 6/2014 | Kuster | 381/66 |

* cited by examiner

*Primary Examiner* — Peter Vincent Agustin
(74) *Attorney, Agent, or Firm* — Haynes and Boone, LLP

(57) ABSTRACT

A method for continuously estimating reverberation decay comprising receiving a sequence of audio data samples. Determining whether a plateau is present in the sequence of audio data samples. Generating one or more reverberation parameters from the sequence of audio data samples if it is determined that the plateau is present.

18 Claims, 5 Drawing Sheets

ESTIMATION OF REVERBERATION DECAY RELATED APPLICATIONS

RELATED APPLICATIONS

The present application claims priority to U.S. Provisional Patent Application No. 61/737,590, filed Dec. 14, 2012, which is hereby incorporated by reference for all purposes as if set forth herein in its entirety.

TECHNICAL FIELD

The present disclosure relates generally to audio signal processing, and more specifically to a system and method for continuously estimating reverberation decay from an audio signal.

BACKGROUND OF THE INVENTION

Suppressing or eliminating reverberation effects on reverberated noisy speech is used with automatic speech recognition engines. Reverberation suppression typically requires the estimation of certain reverberation parameters either with the knowledge of the actual speech excitation (direct method) or without (blind method). Direct methods, though very accurate, are not practical in most situations, necessitating the need for blind methods. Blind techniques that estimate the reverberation parameters often rely on accurate speech activity detection, and will not function properly without accurate speech activity detection.

SUMMARY OF THE INVENTION

A method for continuously estimating reverberation decay is disclosed that includes receiving a sequence of audio data samples, such as in the frequency or time domain. It is then determined whether a plateau is present in the sequence of audio data samples. One or more reverberation parameters are generated from the sequence of audio data samples if it is determined that the plateau is present.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
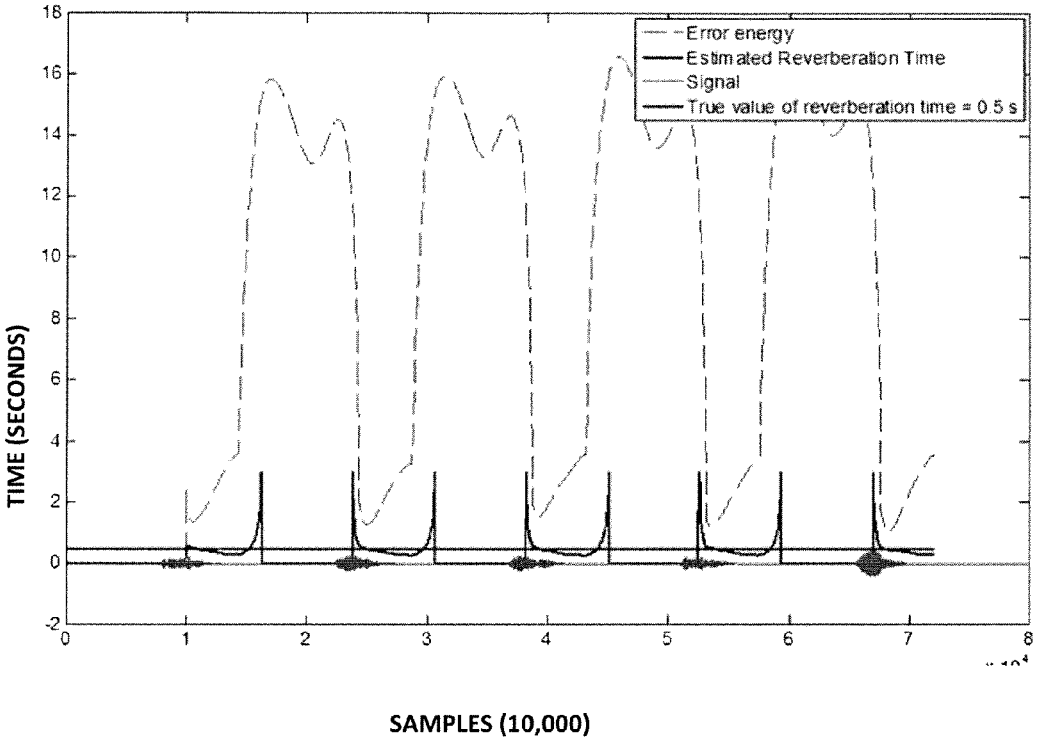
FIG. 1 is a diagram showing the effectiveness of tracking linear regression error energy in identifying valid decay regions, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

Reverberation is a particularly troublesome form of signal distortion that reduces the quality of speech communication and the accuracy of speech recognition. Reverberation is caused by sound energy reflecting off walls and other objects in a room and is a function of the room geometry and the location of the microphone. Reflection is a lossy process, and the reflected sound waves manifest as a slowly decaying energy curve. The rate at which the energy decays can be characterized by a reverberation time parameter. Because speech recognizing software and systems are usually trained on anechoic signals, they have a difficult time interpreting reverberant speech. Reducing the reverberation (de-reverberation) in a captured microphone signal is an important step that should be performed before the signal is handled by the speech recognition and communication channels.

Estimating the reverberant spectrum and subtracting it from the reverberant signal is one approach for performing speech de-reverberation. The reverberation time parameter is assumed to be known/estimated. In applications where there is an echo canceller, the reverberation time can be estimated from the impulse response of the canceller. In applications that do not have an echo canceller, the reverberation time has to be estimated from the microphone measurement. The present disclosure provides systems and methods of calculating the reverberation time where there is no echo-canceller and the only observable signal is the microphone measurement.

In a conversation, there are frequent speech pauses. The best segment from which to calculate speech decay is during speech pauses of considerable duration. Previous solutions model the decay curve in the pauses or use a maximum likelihood (ML) approach to estimate the reverberation time that best explains the decay. These approaches are not preferred, because the energy based speech pause detection is unreliable and the ML approach requires a way of choosing valid estimation windows. The present disclosure solves both the speech pause detection problem and choosing valid reverberation time problem.

The measured signal can be represented as y(n), and the log of the energy curve can be represented as $L_y(n)$. During a speech pause, the long-term decay of speech energy follows an exponential decay that can be represented by:

$$y(n)=s(n)e^{-\rho T_s n} \tag{1}$$

where ρ is the decay rate, $T_s$ is the sampling period and s(n) is a random noise model for the speech signal and the room parameters. The exponential decay manifests as a linear decay of the log-energy $L_y(n)$.

The reverberation time $T_{60}$ can be defined as the time for the energy to decay to 60 dB below the initial value. From equation (1), it can be deduced that the following relationship is accurate:

$$T_{60} \cong \frac{6.93}{\rho} \tag{2}$$

The speech can be divided into a sequence of frame samples, where the observation frame window can be N frame samples. If the frame index is m, the problem can be characterized as fitting a straight line to $L_y(n)$ into the frame m. Let the straight line be represented by:

$$z(n)=a_m n+b_m \tag{3}$$

where $a_m$ and $b_m$ are estimated through least-squares techniques. Based upon this representation, the reverberation time can be shown to be represented by:

$$T_{60}(m) = 13.86\frac{T_s}{a_m} \tag{4}$$

It should be noted that for most rooms $T_{60}$ falls between 0.3 to 2 seconds and that very low values and very high values of $T_{60}$ can be discarded.

The goodness of the fit can be indicated by the error sequence $e_m(n)$ which is given by:

$$e(m) = \frac{1}{N}\sum_{n=mN}^{(m+1)N-1}\{L_y(n) - z_m(n)\}^2 \tag{5}$$

For a long window where $N \cdot T_s$=0.5 seconds, the corresponding error sequence will hit a minimum during (1) speech pauses and (2) the absence of speech. During the absence of speech, the best least squares linear fit will be the mean of the ambient noise. Assuming that the mean is zero, the slope of the estimated line is zero, and thus the reverberation time calculated using (4) can be discarded. During and after the speech pauses, $e_m(n)$ hits a minimum and the corresponding reverberation time estimate using (4) will reflect the true value.

FIG. 1 is a diagram 100 showing the effectiveness of tracking linear regression error energy in identifying valid decay regions in accordance with an exemplary embodiment of the present disclosure. By fitting a long line to the log energy sequence and tracking the minima of the corresponding error, both the problems of identifying valid speech pauses and estimating the reverberation time are solved.

The present disclosure thus allows speech pauses that are sufficient to calculate reverberation time to be automatically identified, and does not require additional processing for speech/voice or activity/noise detection. Accordingly, the computational complexity is reduced, and in particular, the present solution does require root finding procedures. In addition, the present disclosure can be generalized to sub-band processing, because reverberation parameters exhibit a frequency dependency.

Suppressing or eliminating reverberation effects on reverberated noisy speech is critical for current automatic speech recognition engines. Most techniques that estimate the reverberation parameters rely on accurate speech activity detection, explicitly or implicitly. The present disclosure provides a procedure for continuously updating estimates that adapts automatically to the speech patterns by evaluating, isolating and zooming-in on the potential regions that deliver reliable estimates. The robustness and dynamic tracking of the present disclosure is further improved by an IIR low pass filter that is used to suppress the effect from the additive noise.

Figure 2:
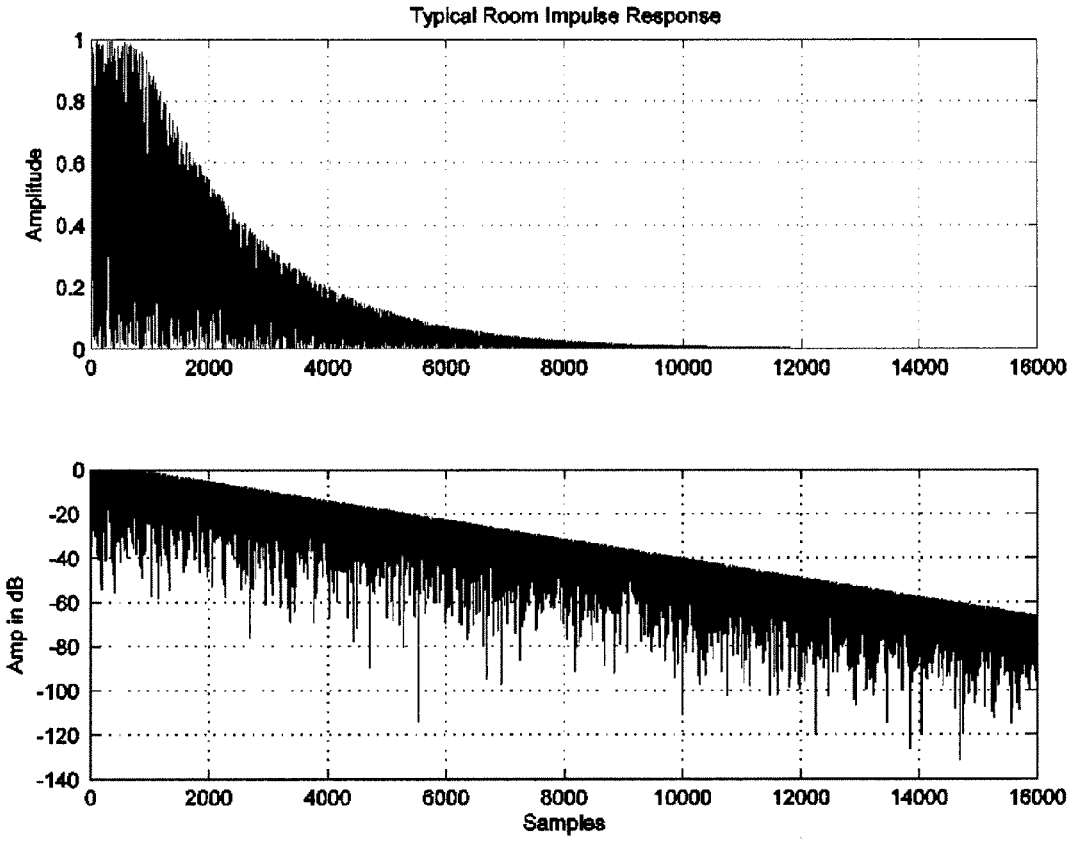
FIG. 2 is a diagram of a typical room acoustic reverberation impulse response.
Figure 3:
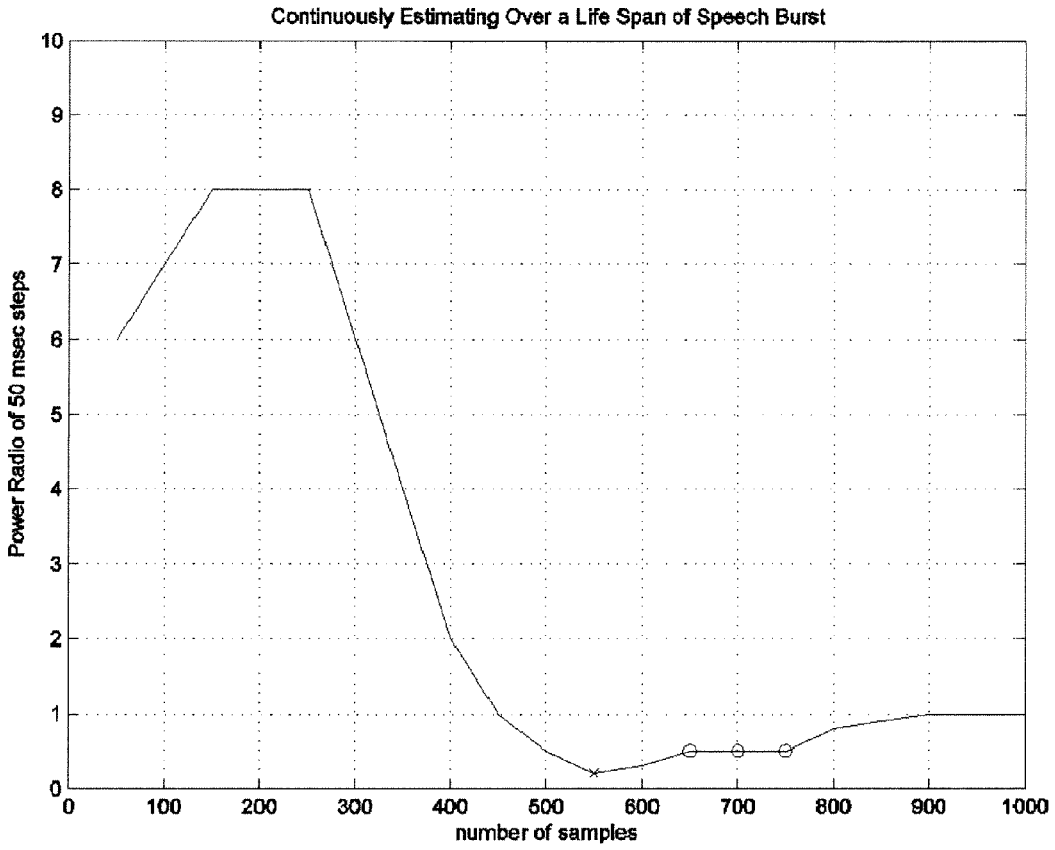
FIG. 3 is a diagram showing the power ratio sequence of a reverberant speech segment, where the minima point indicates the occurrence of a valid reverberation decay.

FIG. 2 is a diagram of a typical room acoustic reverberation impulse response. If the impulse response is known, the standard approach to suppress the effect of reverberation is through inverse filtering or equalization. However, the impulse response is not generally known and can be difficult, if not impossible, to estimate in most applications. Nevertheless, the impulse response can be approximated with a simplified model described by a few parameters. As shown in FIG. 2, an impulse response h(n) has a flat early arrival envelope $h_e(n)$ followed by a long and exponentially decaying tail $h_l(n)$ due to late reflections. The purpose of dereverberation is to reduce or eliminate the effect of the tail on the speech components. The following statistical model can be used to describe the tail (in discrete-time domain):

$$h_l(n)=b(n)\exp\{-\rho n T_s\} \tag{6}$$

where ρ is the decay factor, Ts is the sampling frequency and b(n) is a zero mean Gaussian stationary noise. Furthermore, b(n) can be modeled as white noise for simplicity. With the tail modeled as above, the reverberant portion can be separated from the perceptually benign portion of the envelope of the impulse response, as shown in FIG. 3. The early arrival portion, $h_e(n)$, can be preserved, as it does not substantially affect the performance of automatic speech recognition or the perceptual quality of the speech.

The reverberant tail can be used for modeling and the early arrival $h_e(n)$ can be ignored, as shown in the following analysis in continuous time-domain. The clean speech signal is represented by s(t) and the reverberation response by $h_l(t)$, as shown in Eq. (6). The noisy reverberant recording can be modeled as follows:

$$x(t)=\int_{-\infty}^{\infty}s(\theta)h_l(t-\theta)d\theta=\exp\{-\rho t\}\int_{-\infty}^{t}s(\theta)b(t-\theta)\exp(\rho\theta)d\theta \tag{7}$$

If s(t) and b(t) are independent, the autocorrelation of the noisy signal can be represented as:

$$E[x(t)x(t+\rho)]=\exp\{-\rho t\}\int_{-\infty}^{t}E[s(\theta)s(\theta+\tau)]\sigma_b^2\exp\{2\rho\theta\}d\theta \tag{8}$$

where $\sigma_b^2=E[|b(t)|^2]$. Taking the autocorrelation at a T time delay yields:

$$E[x(t+T)x(t+T+\tau)]=\exp[(\{-2\rho t\}E[x(\theta)x(\theta+\tau))]]+\exp\{-2\rho(T+t)\}\int_t^{t+T}E[s(\theta)s(\theta+\tau)]\sigma_b^2\exp\{2\rho\theta\}d\theta \tag{9}$$

where the first term on the right hand side depends on the past reverberated signal and the second term depends on the clean signal s(t) between time t and t+T. If the signal dies down at time t, the second term becomes zero, such that:

$$E[x(t+T)x(t+T+\tau)]=\exp\{-2\rho T\}E[x(\theta)x(\theta+\tau)] \tag{10}$$

and the reverberation decay can be estimated as:

$$\exp\{-2\rho T\}=E[x(t+T)x(t+T+\tau)]/E[x(\theta)x(\theta+\tau)] \tag{11}$$

Equation (11) constitutes the foundation for most of the current approaches estimating acoustic reverberation decay, and requires that the clean signal be paused within the evaluation interval [t, t+T]. However, the determination of a pause of the speech is difficult in noisy environments.

Identifying speech pauses in noise is difficult. As previously discussed, an accurate estimation of the reverberation decay can occur only at the end of a speech burst. However, relying on a speech activity detector makes it difficult to design a robust algorithm for reverberation estimation. The present disclosure provides an algorithm that can automatically track and use the speech burst properties in a way that improves the robustness and in turn the accuracy of the estimation, without explicitly making decisions on the speech in any way during the estimation process.

To further simplify Equation (11), the reverberation decay is estimated by the power ratio instead of the autocorrelation ratio. A typical speech burst goes through the transitions of three stages: attack (energy builds up), hold (energy maintains relatively constant) and release (energy goes down to zero). The effects of the speech burst can be modeled as a certain recognizable pattern if the power ratio is continuously evaluated block by block without distinguishing the presence or absence of the speech bursts. A pattern recognition mechanism is followed to process the ratio sequence and find the regions that most likely produce reliable estimates. FIG. 3 shows the power ratio patterns of a typical speech burst. The minimum of the power ratio, as marked by "x" almost always occurs right before the more reliable estimates, as marked by "O." In addition, the reliable estimates are usually clustered to form a plateau. These two observations can be used in conjunction with pattern matching to locate the most reliable decay estimation.

In one exemplary embodiment, the following steps can be used to locate the most reliable decay estimate:

1) compute the power of the noisy signal, $|x(m)|^2$, for every M samples apart 2) compute the power ratio sequence, $r(m)=|x(m)|^2/|x(m-1)|^2$ 3) group B number of consecutive r(m) into a block, R(iB)=[r(iB), r(iB+1), . . . , r((i+1)B−1)], 4) find the minimum and index, indexRmin(i), of R(iB), 5) search for a plateau pattern within a window right after indexRmin(i), 6) if a plateau is found in 5), the value is considered a valid estimation point for reverberation decay, 7) if no plateau found in 5), move to next block, R((i+1)B).

The parameter M, the sampling interval of the noisy power, is closely related to the length of the plateau, and B should be 1.5 or 2 times an average speech burst. Since there is typically an expected range for the reverberation decay, the search for the plateau in step 5) can be implemented as quantization bin counting. When the plateau is found in step 5, step 6 can be implemented in one exemplary embodiment by using a maximum likelihood estimator. For example, if Lh is the length of the reverberant impulse, for a dynamic reverberation environment, h(k,l):

$$x(k)=\Sigma_{l=0}^{L_H-1}s(k-l)h(k,l) \tag{12}$$

Within the reliable region detected in step 5, the speech pause is assumed to start at time k, $$s(k,l)=\begin{cases}0, & l<L_0\\ \text{unknown}, & l\geq L_0\end{cases} \tag{13}$$

where $L_0$ demarcates the end of the early part of reverberation and the beginning of the late part of reverberation.

The room reverberation during the pause of speech can be estimated as:

$$x(k)=\Sigma_{l=L_0}^{L_h-1}s(k-1)h(k,l) \tag{14}$$

which also represents the resultant of sound decay, and is denoted as d(k) to differentiate it from the noisy signal, which yields:

$$d(k)=b(k)\exp\{-\rho kT_s\}u(k) \tag{16}$$

where b(k) is defined in Eq. (7), and u(k) is a unit step function. The energy decay curve can be represented as:

$$E[d(k)^2]=\sigma_b^2\exp\{-2\rho kT_s\}u(k) \tag{17}$$

and d(k) follows the following distribution:

$$p_{d(k)}(x)=\frac{1}{\sqrt{2\pi}\,\sigma(k)}\exp\left\{-\frac{x^2}{2\sigma^2(k)}\right\} \tag{18}$$

where $$\sigma(k)=\sigma_b\exp\{-\rho kT_s\}u(k) \tag{19}$$

The sequence d(k) for $k\in\{0,\ldots,N-1\}$ restricted within the reliable region as defined in step 6, is modeled by N independent random variables with zero mean and non-identical variances. This allows for ML estimator for the unknown parameter decay rate ρ.

$$\hat{\rho}^{ML}=\max_\rho L(\rho) \tag{20}$$

having the log-likelihood:

$$L(\rho)=-\frac{N}{2}\left((N-1)\ln(\rho T_s)+\ln\left(\frac{2\pi}{N}\sum_{k=0}^{N-1}e^{-2T_s\rho i}d^2(i)\right)+1\right) \tag{21}$$

If computation resources are not an issue, the above estimation algorithm can provide an optimal ML estimate.

The noisy reverberated signal can be continuously processed, one block at a time, and a suitable number of consecutive blocks can be grouped together as a basic window. For each window, the minimum estimate location is located and plateau pattern matching is performed. If a plateau pattern is found, the decay estimate is updated, otherwise, the old decay rate is used. In one exemplary embodiment, a fixed updating parameter a can be selected as follows:

$$\delta_{new}=\alpha\delta_{pre}+(1-\alpha)\delta_{cur} \tag{22}$$

and $\delta_{new}$ is assigned to $\delta_{pre}$ in next basic window.

The above averaging provides two advantages. First, the effect of the additive noise is alleviated (which has not been included in the problem formulation so far). Second, the dynamics of the reverberation environment are tracked automatically. To further improve the performance, α can be adjusted by a reliability measure at each block.

Figure 4:
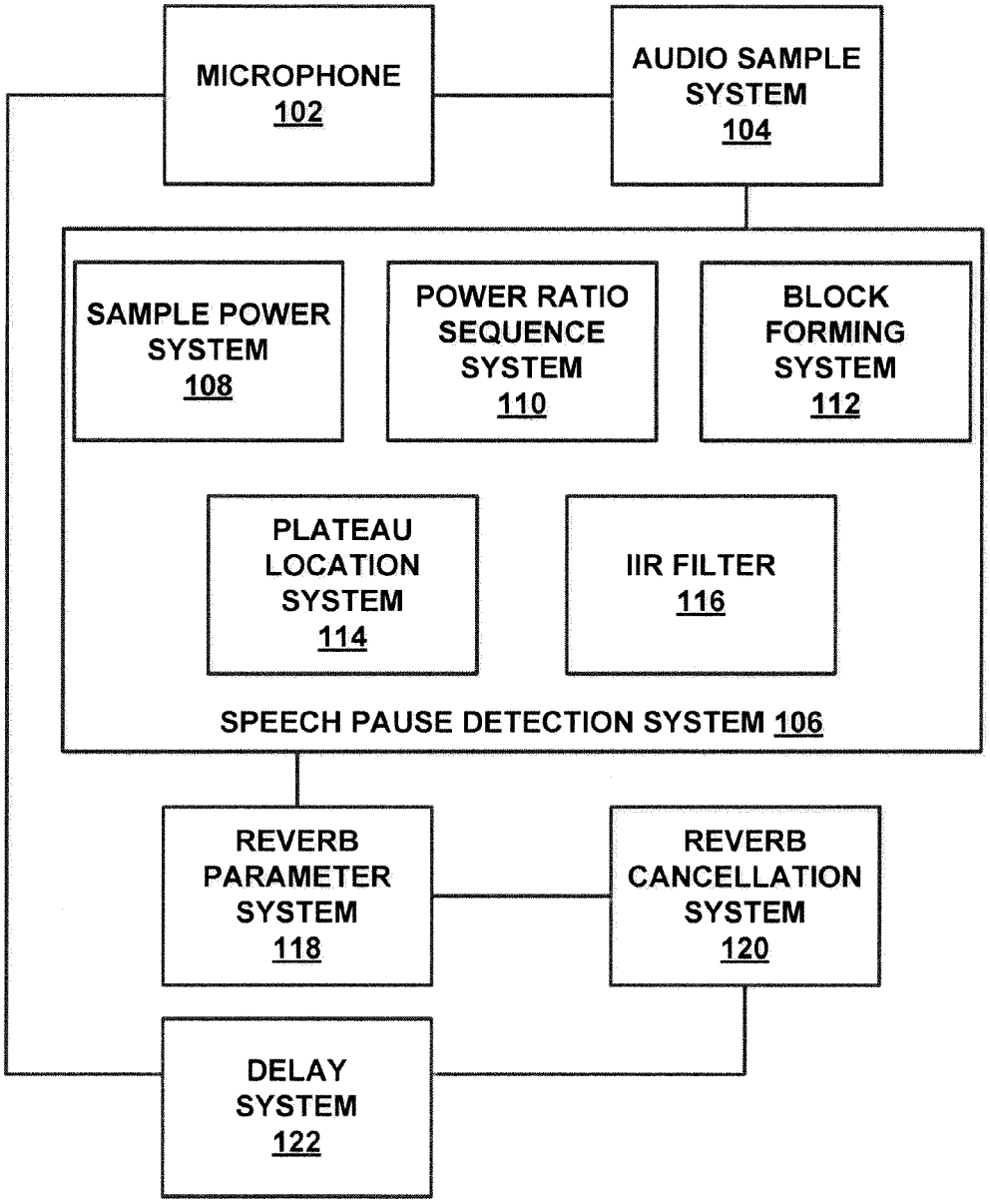
FIG. 4 is a diagram of a system for identifying speech pauses and estimating reverberation parameters in accordance with an exemplary embodiment of the present disclosure.

FIG. 4 is a diagram of a system 400 for identifying speech pauses and estimating reverberation parameters in accordance with an exemplary embodiment of the present disclosure. System 400 includes microphone 102, audio sample system 104, speech pause detection system 106, sample power system 108, power ratio sequence system 110, block forming system 112, plateau location system 114, IIR filter 116, reverb parameter system 118, reverb cancellation system 120 and delay system 122, each of which can be implemented in hardware or a suitable combination of hardware and software.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Microphone 102 receives audio signals and converts the audio signals into electrical signals. In one exemplary embodiment, microphone 102 can be implemented as one or more separate microphones, and can generate analog electrical signals, digital electrical signals or other suitable signals.

Audio sample system 104 is coupled to microphone 102, receives the electrical signals from microphone 102 and generates sample data. In one exemplary embodiment, audio sample system 104 generates a sequence of frame samples in the time domain, the frequency domain, or other suitable frame samples. Audio sample system 104 can be implemented using discrete digital processing components, a digital signal processor with suitable algorithmic programming or in the other suitable manners.

Speech pause detection system 106 is coupled to audio sample system 104, receives the sequence of frame samples and identifies a speech pause for estimation of reverberation parameters. In one exemplary embodiment, speech pause detection system 106 continuously analyzes the sequence of time frames and generates and outputs data that can be used to determine reverberation parameters. Speech pause detection system 106 can be implemented using discrete digital processing components, a digital signal processor with suitable algorithmic programming or in the other suitable manners.

Sample power system 108 receives the sequence of frames of audio data and generates data representing the power of the audio signal that is represented by the sequence of frames of audio data. In one exemplary embodiment, sample power system 108 computes a power of the audio signal $|x(m)|^2$ for every M samples, as described further herein. Sample power system 108 can be implemented using discrete digital processing components, a digital signal processor with suitable algorithmic programming or in the other suitable manners.

Power ratio sequence system 110 receives the data representing the power of the audio signal and generates power ratio sequence data. In one exemplary embodiment, power ratio sequence system 110 generates the power ratio sequence, $r(m)=|x(m)|^2/\|x(m-1)|^2$, as described further herein. Power ratio sequence system 110 can be implemented using discrete digital processing components, a digital signal processor with suitable algorithmic programming or in the other suitable manners.

Block forming system 112 receives the power ratio sequence data and generates a block of power ratio sequences. In one exemplary embodiment, block forming system 112 generates a group B number of consecutive r(m) into a block, $R(iB)=[r(iB), r(iB+1), \ldots, r((i+1)B-1)]$, as described further herein. Block forming system 112 can be implemented using discrete digital processing components, a digital signal processor with suitable algorithmic programming or in the other suitable manners.

Plateau location system 114 receives the block of power ratio sequences and determines whether a plateau pattern is present within the block. In one exemplary embodiment, plateau location system 114 can find the minimum and index, indexRmin(i), of R(iB), and search for a plateau pattern within a window right after indexRmin(i), as described further herein. If a plateau is located, plateau location system 114 outputs the corresponding sequence of frames of audio data, as described further herein. Plateau location system 114 can be implemented using discrete digital processing components, a digital signal processor with suitable algorithmic programming or in the other suitable manners.

IIR filter 116 receives the frames of audio data and performs infinite impulse response filtering on the audio data to suppress the effects of additive noise. In one exemplary embodiment, IIR filter 114 can perform low pass filtering, as described further herein. IIR filter 116 can be implemented using discrete digital processing components, a digital signal processor with suitable algorithmic programming or in the other suitable manners.

Reverb parameter system 118 receives the filtered frames of audio data and generates reverb parameters for elimination of reverberation signals from the microphone signal. In one exemplary embodiment, the reverb parameters can include a reverb time constant estimate as further described herein. Reverb parameter system 118 can be implemented using discrete digital processing components, a digital signal processor with suitable algorithmic programming or in the other suitable manners.

Reverb cancellation system 120 receives the reverb parameters from reverb parameter system 118 and the microphone signal from delay 122 and generates a reverb cancelled audio signal. Reverb cancellation system 120 can be implemented using discrete digital processing components, a digital signal processor with suitable algorithmic programming or in the other suitable manners.

In operation, system 400 can estimate reverberation echo decay for use in processing audio data to generate an echo corrected audio data signal. System 400 can be used to process speech data for speech recognition or other suitable purposes, and does not require a speech activity detector, echo canceller or other expensive and complex systems and components.

Figure 5:
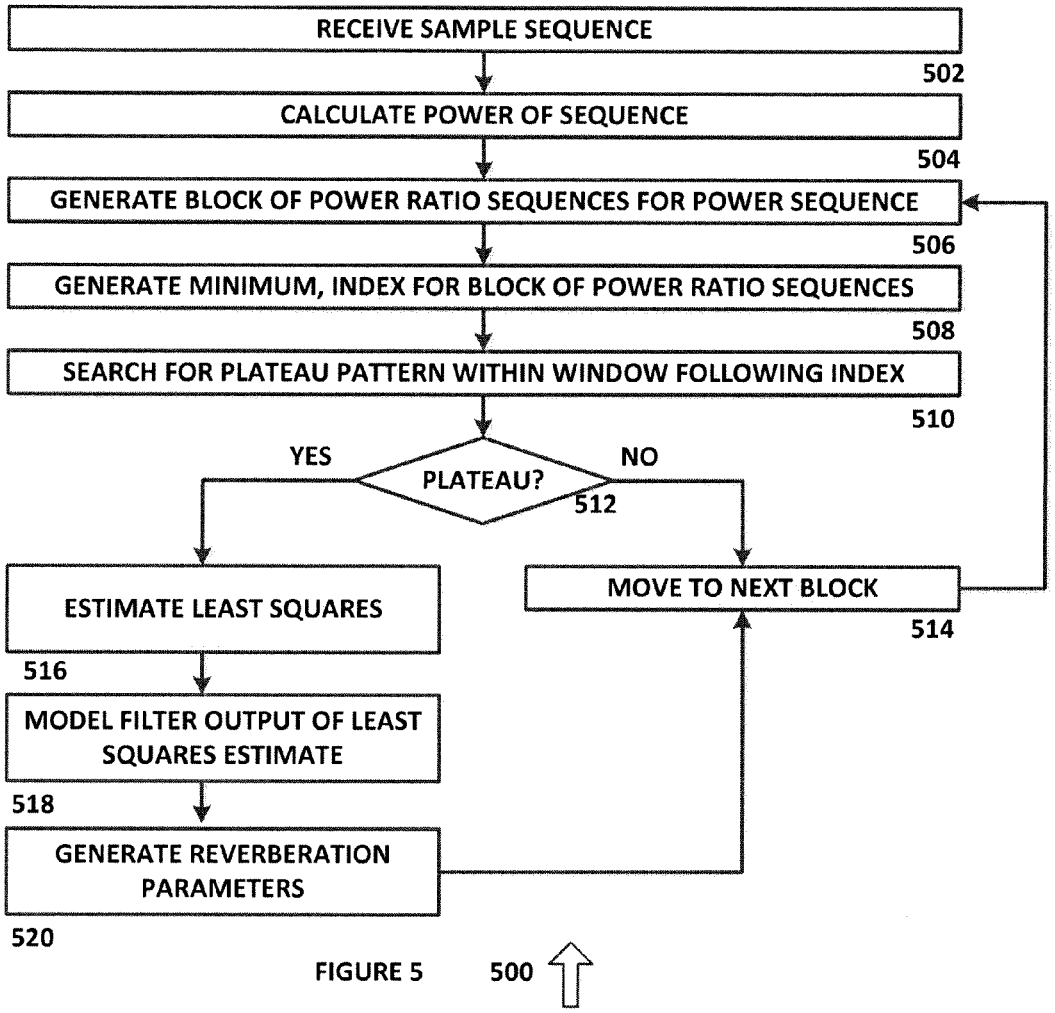
FIG. 5 is a diagram of an algorithm for continuously estimating reverberation decay in accordance with an exemplary embodiment of the present disclosure.

FIG. 5 is a diagram of an algorithm 500 for continuously estimating reverberation decay in accordance with an exemplary embodiment of the present disclosure. Algorithm 500 can be implemented in hardware or a suitable combination of hardware and software, and can be one or more algorithms operating on a processor.

Algorithm 500 begins at 502, where a sample sequence is received. In one exemplary embodiment, the sample sequence can include a sample sequence of digital audio samples, such as from an audio recording system, from audio-visual data files or from other suitable sources. The algorithm then proceeds to 504.

At 504, a power of the sample sequence is computed or calculated, such as by computing the power of the signal, $|x(m)|^2$, for every M samples apart or in other suitable manners. In one exemplary embodiment, the sample sequence of digital audio samples can be stored at predetermined memory locations in a digital data memory and a set of M samples can be extracted and used to calculate the power of the sample sequence with a multiplier circuit, a processor having suitable programming, or in other suitable manners. The algorithm then proceeds to 506.

At 506, the power ratio sequence, $r(m)=)|^2/|x(m-1)|^2$ is generated, and is then formed into blocks. In one exemplary embodiment, the power of the sample sequence calculated at 504 and other suitable data in conjunction with multiplication, division and subtraction circuitry is used to generate the power ratio sequence, the power ratio sequence is generated in conjunction with a processor having suitable programming, or the power ratio sequence is generated in other suitable manners. A number of consecutive r(m) values are then grouped into a block, R(iB)=[r(iB), r(iB+1), . . . , r((i+1)B−1)], such as by storing block data addresses in predetermined memory locations, by storing the consecutive r(m) values in a predetermined block of memory locations, or in other suitable manners. The algorithm then proceeds to 508.

At 508, the minimum and index, indexRmin(i), of R(iB) is calculated. In one exemplary embodiment, the block of consecutive r(m) value generated at 506 and other suitable data in conjunction with multiplication, division and subtraction circuitry is used to generate the minimum and index of R(iB), the minimum and index of R(iB) are generated in conjunction with a processor having suitable programming, or the minimum and index of R(iB) are generated in other suitable manners. The algorithm then proceeds to 510.

At 510, a window of r(m) values following indexRmin(i) is searched to determine whether a plateau is present in the data. In one exemplary embodiment, the values of r(m) can be compared to each other to determine whether they are within a predetermined tolerance using compare circuitry, using a processor with suitable programming or in other suitable manners. The algorithm then proceeds to 512.

At 512, it is determined whether a plateau has been identified, such as by referencing a status register from the compare process of 510 or in other suitable manners. If it is determined that a plateau has not been found, the algorithm proceeds to 514 and moves to the next block for analysis. Otherwise, the algorithm proceeds to 516 where a least squares is estimated using equation (3) implemented with processing circuitry, using a processor with suitable software or in other suitable manners. The algorithm then proceeds to 518 where the filter output of the least square fit is modeled, and the algorithm proceeds to 520 where reverberation parameters are generated, such as using equation (4) implemented with processing circuitry, using a processor with suitable software or in other suitable manners. The algorithm then proceeds to 514.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A method for cancelling reverberation from an audio speech signal comprising:

electronically receiving a sequence of audio data samples representing the audio speech signal;

determining whether a plateau pattern is present in the sequence of audio data samples using electronic data processing equipment;

generating an estimate of the reverberation by defining one or more reverberation parameters from the sequence of audio data samples if it is determined that the plateau pattern is present; and subtracting the estimate of the reverberation from the audio speech signal.

2. The method of claim 1 wherein determining whether the plateau pattern is present comprises calculating a power of the sequence of audio data samples.

3. The method of claim 1 wherein determining whether the plateau pattern is present comprises generating a power ratio sequence for a power sequence of the audio data samples.

4. The method of claim 2 wherein determining whether the plateau pattern is present comprises generating a block of power ratio sequences.

5. The method of claim 4 wherein determining whether the plateau pattern is present further comprises generating a minimum value and an index value for the block of power ratio sequences.

6. The method of claim 5 wherein determining whether the plateau pattern is present further comprises searching for the plateau pattern within a predetermined window of samples following the index value.

7. The method of claim 1 wherein generating the estimate of the reverberation by defining one or more reverberation parameters from the sequence of audio data samples if it is determined that the plateau pattern is present comprises generating a least squares estimate of the sequence of audio data samples.

8. The method of claim 7 further comprising modeling a filter output of the least squares estimate.

9. The method of claim 8 further comprising generating the reverberation parameters using the modeled filter output.

10. The method of claim 1 wherein the electronic data processing equipment comprises one of a digital signal processor programmed with one or more algorithms or one or more discrete electronic components.

11. A system for cancelling reverberation from an audio speech signal by continuously estimating reverberation decay comprising:

an audio sample system configured to receive the audio speech signal and to generate a sequence of samples of the audio speech signal using electronic data processing equipment;

a speech pause detection system coupled to the audio sample system and configured to receive the sequence of samples of the audio speech signal and to locate a plateau in the sequence of samples of the audio data;

a reverb parameter system coupled to the speech pause detection system and configured to receive a plurality of samples of the audio data associated with the plateau and generate an estimate of the reverberation by setting one or more reverberation decay parameters; and a reverb cancellation system coupled to the reverb parameter system and configured to subtract the estimate of the reverberation from the audio speech signal.

12. The system of claim 11 wherein the speech pause detection system comprises a sample power system configured to receive the sequence of samples of the audio data and generate sample power data.

13. The system of claim 12 wherein the speech pause detection system comprises a power ratio sequence system configured to receive the sample power data and generate power ratio sequence data.

14. The system of claim 13 wherein the speech pause detection system comprises a block forming system configured to receive the power ratio sequence data and generate a block.

15. The system of claim 14 wherein the speech pause detection system comprises a plateau location system configured to receive the block, locate a minimum and index within the block, and determine whether a plateau pattern is present after the index.

16. The system of claim 15 wherein the speech pause detection system comprises a filter configured to filter samples of audio data associated with the plateau pattern.

17. The system of claim 11 wherein the reverb parameter system is configured to continuously estimate a least-squares model and to filter the output of the least-squares model estimate.

18. The system of claim 11 wherein the electronic data processing equipment comprises one of a digital signal processor programmed with one or more algorithms or one or more discrete electronic components.

* * * * *